United States Patent [19]

Staba

[11] 3,963,544

[45] June 15, 1976

[54] PRIMING FORMULATION FOR RIM FIRE AMMUNITION

[75] Inventor: Edward Anthony Staba, Higganum, Conn.

[73] Assignee: Olin Corporation, New Haven, Conn.

[22] Filed: Sept. 4, 1975

[21] Appl. No.: 610,512

[52] U.S. Cl. ..... 149/23; 102/86.5; 149/24; 149/28

[51] Int. Cl.[2] ..... C06C 7/00

[58] Field of Search ..... 102/86.5; 149/23, 24, 149/28

[56] References Cited

FOREIGN PATENTS OR APPLICATIONS

| | | | |
|---|---|---|---|
| 535,596 | 1/1957 | Canada | 149/28 |
| 705,346 | 3/1965 | Canada | 149/28 |

*Primary Examiner*—Leland A. Sebastian

*Attorney, Agent, or Firm*—Donald R. Motsko; William W. Jones

[57] ABSTRACT

A priming composition for use in ammunition, which priming composition contains as a frictionator and sensitizer ground metallic oxide particles, such as cupric oxide, in place of ground glass.

3 Claims, No Drawings

PRIMING FORMULATION FOR RIM FIRE AMMUNITION

This invention relates to a priming composition useful in priming rim fire ammunition, which priming composition contains ground metallic oxide particles as a frictionator and sensitizer in place of ground glass.

It is, of course, well known that ammunition priming composition used to form primers for percussion-type ammunition rounds should contain a frictionator and sensitizer for proper operation. This frictionator has most commonly taken the form of ground glass, although other materials have been suggested for use, such as ground carbonations material, such as hard coal, or the like.

The use of ground glass as a frictionator is generally acceptable for most priming compositions and processes, however, it has been found to provide a priming composition which is too sensitive to provide optimum performance in a priming process described in U.S. Pat. No. 3,257,892, issued June 28, 1966 to C. L. Hubbard wherein a rim fire cartridge is headed after the priming composition has been deposited in the roughly formed rim. The high sensitivity of glass-containing priming compositions results in an undesirably high incidence of deflagration of the primer composition during the subsequent final forming of the rim of the cartridge casing. This phenomenon is termed "pop" and of course cannot be tolerated.

My invention relates to a glassless priming composition which may be used to form primers for ammunition. The priming composition of my invention can be used for any type of percussion primer, but has been found to be particularly useful in priming rim fire ammunition wherein the rim of the cartridge casing is finally formed after the priming composition has been deposited in place in accordance with the method disclosed in U.S. Pat. No. 3,257,892. The priming composition of my invention contains as a frictionator and sensitizer ground particles of a metallic oxide such as crystalline or amorphous cupric oxide (CuO), instead of the conventional ground glass. The particle size of the ground metallic oxide is preferably less than about 100 mesh. Priming compositions using a ground metallic oxide frictionator instead of ground glass are found to be sufficiently sensitive to provide satisfactory ignition characteristics for ammunition firing, and yet are not so highly sensitive as to be subject to "pops" during the heading after priming operation.

The metallic oxide selected should be available in ground crystalline or amorphous granular form, should be relatively inert chemically so as not to chemically react when combined with the remainder of the priming mixture constituents, and should possess rather limited abrasiveness. The amount of abrasiveness should be high enough to provide for dependable ignition when the ammunition is fired, but not so high as to cause premature ignition when round is being formed.

A specific example of a glassless priming composition having a metallic oxide frictionator and sensitizer with percentage given by weight is:

| | |
|---|---|
| Styphnate | 45% |
| Tetracene | 5% |
| Lead Peroxide | 7% |
| Barium Nitrate | 20% to 30% |
| Cupric Oxide | 13% to 23% |

The above example is merely exemplary of a working embodiment of the invention and is not meant to be limiting. For example, the invention can be practised with a priming composition containing a fuel constituent. Other primary explosives and/or oxidizers can be used in place of those specified.

The above composition was tested with the head after priming process disclosed in U.S. Pat. No. 3,257,892 and compared with the same process and the same formulation but using ground glass as the frictionator. In 10,000 rounds using the glassless priming composition formed, only two "pops" occurred. In 10,000 rounds of the glass-containing priming composition ½ to 1% of the rounds formed "popped" during the heading operation. The glassless rounds formed were also ballistically compared with the glass-containing rounds and were found to perform on a par with the glass-containing composition.

Since many changes and variations of the disclosed embodiment of the invention may be made without departing from the inventive concept, it is not intended to limit the invention otherwise than as required by the appended claims.

What is claimed is:

1. A glassless priming composition for percussion ignition ammunition, said composition comprising: at least one primary explosive constituent; at least one oxidizing constituent; and a frictionator and sensitizer consisting of particles of ground cupric oxide.

2. The composition of claim 1 wherein said cupric oxide has a particle size of less than about 100 mesh.

3. The composition of claim 1, wherein said cupric oxide forms about 13% to 23% of the weight of the composition.

* * * * *